US006604310B1

(12) United States Patent
Lindström et al.

(10) Patent No.: US 6,604,310 B1
(45) Date of Patent: Aug. 12, 2003

(54) LABEL HOLDER

(75) Inventors: Jan Lindström, Sundsvall (SE); Anders Lange, Matfors (SE)

(73) Assignee: HL Display AB, Skarpnack (SE)

( * ) Notice: Subject to any disclaimer, the term of this patent is extended or adjusted under 35 U.S.C. 154(b) by 0 days.

(21) Appl. No.: 10/088,993

(22) PCT Filed: Sep. 7, 2000

(86) PCT No.: PCT/SE00/01737

§ 371 (c)(1),
(2), (4) Date: Mar. 26, 2002

(87) PCT Pub. No.: WO01/24143

PCT Pub. Date: Apr. 5, 2001

(30) Foreign Application Priority Data

Sep. 27, 1999 (SE) ..... 9903484

(51) Int. Cl.[7] ..... G09F 3/00
(52) U.S. Cl. ..... 40/642.01; 40/661
(58) Field of Search ..... 40/642.01, 642.02, 40/661, 5

(56) References Cited

U.S. PATENT DOCUMENTS 4,801,116 A * 1/1989 Blankenship ..... 40/661
5,815,970 A * 10/1998 Thalenfeld et al. ..... 40/642.01
5,826,359 A * 10/1998 Thalenfeld et al. ..... 40/642.01
6,269,571 B1 * 8/2001 Thalenfeld ..... 40/642.01
6,279,256 B1 * 8/2001 Norolof et al. ..... 40/642.01
6,389,722 B1 * 5/2002 Josefsson et al. ..... 40/642.01

* cited by examiner

*Primary Examiner*—Gary Hoge
(74) *Attorney, Agent, or Firm*—Sughrue Mion, PLLC

(57) ABSTRACT

Label holder intended to be mounted in a hanging manner on a pin (6) which is arranged tranversely to a bar (3) projecting from a product display stand or equivalent. The holder (4) is provided with members (5) which make possible articulated mounting of the holder on the pin (6) and members for adjusting the angle the holder forms with the bar. To this end, the holder (4) is provided with an adjustment member on its rear side, which comprises a displaceable engagement element (9, 10) which is adapted so as to be capable of being displaced upward in the direction of the bar (3). The engagement element (9, 10) can then enter into engagement with the bar (3) when the holder (4) forms different angles with the latter and constitutes a support for the holder (4) which retains the latter in an angular position occupied relative to the bar (3).

7 Claims, 2 Drawing Sheets

LABEL HOLDER

The present invention relates to a label holder intended to be mounted in a hanging manner on a pin which is arranged transversely to a bar projecting from a product display stand or equivalent, which holder is provided with members which make possible articulated mounting of the holder on the pin and members for adjusting the angle the holder forms with the bar.

The label holder is intended primarily for use in shops and the like in order to indicate price and/or other information about products which are displayed on pronged racks, for example products arranged in packs threaded onto long essentially horizontal prongs.

By using a label holder mounted on a bar, the price label or equivalent can then be made to hang down pivotably in front of the products on the prong. By virtue of the fact that the label holder is pivotable in the vertical direction, the removal of products from the prong and the filling of new products onto the prong are not prevented.

In our U.S. Pat. No. 5,442,872, a previous embodiment of a bar-mounted label holder for use together with pronged racks is described. However, this holder can occupy only one position.

As pronged racks can comprise product display prongs located at different levels, the reading of, for example, labels located at low levels is made difficult if those are displayed by means of a vertically orientated holder. This problem is especially marked in the case of what are known as electronic labels, where the price information and the like is indicated on an electronic display. Such a display is difficult to read if it does not occupy a specific angular position in relation to the viewing line.

A requirement therefore exists for label holders which can be used together with pronged racks and which can be adjusted simply into a number of angular positions relative to the bar on which they are supported.

Such a label holder is described in our Swedish patent application no. 9803810-2. This comprises a number of support surfaces arranged on the rear side of the label holder, which are located at different distances from the rear surface of the holder and can be made to interact selectively with the end surface of the bar so as to allow positioning of the holder at different angles relative to the bar.

This label holder can be adjusted simply into different angular positions by means of a relative displacement between the support surfaces and the bar. As it uses the end surface of the bar as a support surface, it is not suitable for use on bars where the mounting pin is arranged on the end surface of the bar.

SUMMARY OF THE INVENTION

The main object of the present invention is to produce a holder of the type indicated above, which holder can be used irrespective of whether the mounting pin for the holder is fixed on the end surface of the bar or on the lower or upper side of the bar.

This aim is achieved by means of a label holder of the type indicated in the first paragraph, which is characterized by an adjustment member which is arranged on the rear side of the holder and comprises a displaceable engagement element which is adapted so as to be capable of being displaced upward in the direction of the bar so that it can enter into engagement with the bar when the holder forms different angles with the latter and in this connection constitute a support for the holder which retains the latter in an angular position occupied relative to the bar.

The engagement member is suitably lockable in any one of a number of positions, which each represent a specific angle of the holder, and linearly displaceable toward the bar.

In a preferred embodiment, the engagement element is in the form of a slide which runs in a guide on the rear side of the holder, and the slide and the holder are provided with interacting members for locking the slide in the desired position relative to the holder. The interacting members suitably comprise a series of engagement grooves on one part and an engagement strip, intended for interaction with these, on the other part.

Other features of the invention emerge from the patent claims below.

BRIEF DESCRIPTION OF THE DRAWINGS

The invention will be described in greater detail below with reference to the embodiments shown by way of example in the appended drawings, in which.

DETAILED DESCRIPTION OF THE INVENTION

Figure 1:
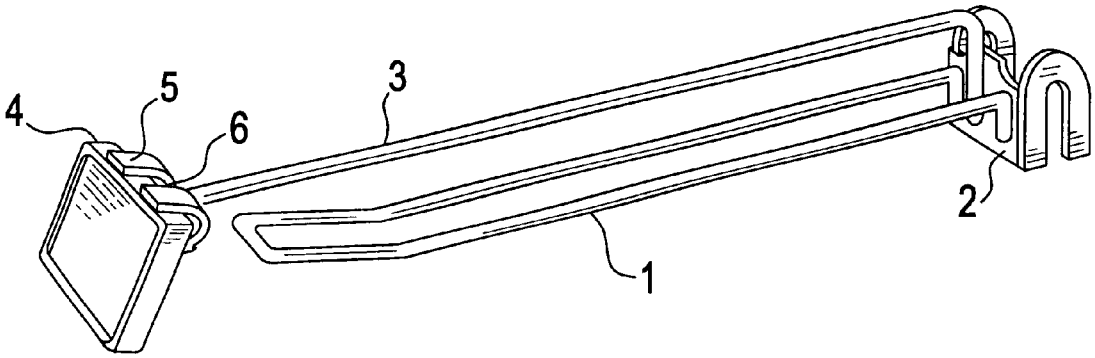
FIG. 1 PRIOR ART
FIG. 1 shows a known label holder intended to be mounted in front of a double product display prong.

In FIG. 1, reference number 1 designates a double product display prong, onto which product packs can be threaded. The prong is supported by a mounting member 2 which is intended to be mounted in a display rack or equivalent.

Also fastened to the mounting member 2 is a bar which projects essentially parallel to the prong 1. A holder 4 is mounted pivotably at the front end of the bar 3. The holder can bear the desired type of label with price information or other information relating to the products hanging on the prong 1. In particular, the holder is intended to bear what is known as an electronic label, that is to say an electronic display on which various items of information relating to the products can be easily changed. However, for optimum reading of such a display, it is necessary for the latter to be capable of being angled so that it is essentially perpendicular to the viewing direction. To this end, the holder 4 is provided with two backwardly directed clips 5 which can be snapped firmly over a transverse pin 6 mounted on the bar 3. The holder can then be pivoted in the vertical direction around the pin.

This known holder is intended to be mounted on a transverse pin 6 arranged on top of the bar 3, the holder 4 being provided with members on its rear surface intended to bear against the end surface of the bar 3. By varying the thickness of these members, the angle of the holder 4 relative to the bar 3 can then be varied.

FIGS. 2–6 illustrate a label holder 4 modified according to the invention, which can be mounted pivotably and adjustably on a pin 6 arranged transversely to the bar 3 irrespective of whether the pin is fixed on the end surface of the bar 3 or on its lower side or upper side.

Figure 2:
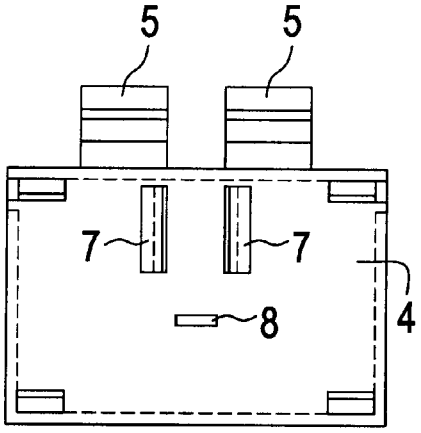
FIG. 2 shows the rear part of a holder arrangement according to the invention, seen from the rear.
Figure 3:
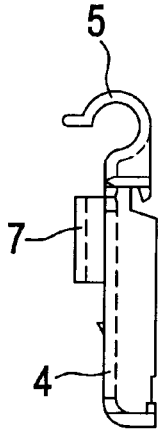
FIG. 3 shows the arrangement according to FIG. 2, seen from the side.
Figure 4:
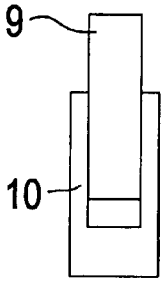
FIGS. 4–6 show an adjustment slide used in the arrangement according to FIG. 1, seen from three different sides.
Figure 5:
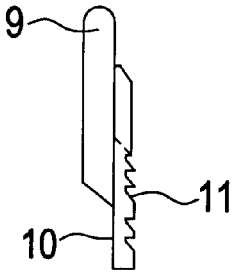
Figure 6:
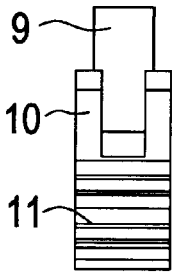

FIG. 2 shows the rear side of the holder 4 with the hook-shaped mounting members 5 projecting up from the holder, see also the side view in FIG. 3. The side view shows only the rear part of the holder 4 without the transparent cover 12 which is mounted in FIGS. 7–9.

On the rear side of the holder, there are two parallel guides 7 and a short, transverse locking strip 8. The guides 7 are intended to receive displaceably a rigid, slide-shaped element 9 according to FIGS. 4–6. The slide 9 has an enlarged lower portion 10 which runs in the guides 7 when the slide is displaced.

On its surface facing the holder 4, the portion 10 is provided with a number of parallel engagement grooves 11. The grooves 11 are intended to be brought into locking engagement with the locking strip 8 on the holder 4. The slide is made and mounted on the holder in such a manner that the locking strip 8 is, in the unactuated state, in locking engagement with one of the grooves 11. However, the locking engagement can easily be freed manually, after which the slide 9 can be displaced linearly in the direction up toward the bar 3 which bears the pin 6 on which the holder 4 is mounted. When the slide 9 is released, it will again be locked in the position occupied in relation to the holder 4.

Figure 7A:
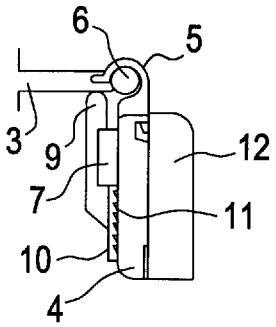
FIGS. 7A–C illustrate a first application of a holder arrangement according to the invention.
Figure 7B:
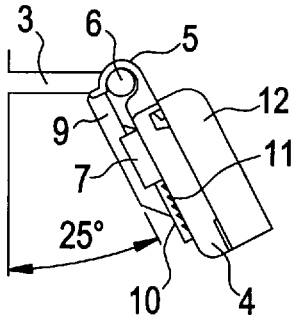
Figure 7C:
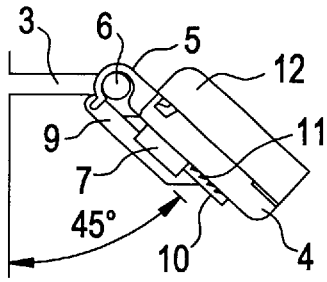

FIGS. 7A–C illustrate the holder 4 mounted on a transverse pin 6 arranged on the front end surface of the bar 3.

In this connection, FIG. 7A shows a position in which the slide 9 has been pushed up so that it enters into engagement with the bar 3 when the holder 5 is located in a vertical position. The slide 9 forms a support for the holder, preventing the latter from being pivoted backward.

In FIG. 7B, the slide 9 has been displaced further upward in relation to the bar, so that the holder 4 is now supported at an angle of 25° in relation to a vertical plane.

FIG. 7C illustrates a further displacement of the slide to bring about an angle of 45° between the holder 4 and a vertical plane.

Depending on the number of engagement grooves 11, the holder 4 can be adjusted into a large number of angular positions. If the grooves are located very close together, virtually continuous adjustment of the angle of the holder can be achieved for adaptation to the height of the product prong in question and the existing light situation.

It is common to all the adjustment positions that the holder can be pivoted further upward from each position so as to simplify the removal of products from a prong located below or for hanging more products on the prong.

Figure 8A:
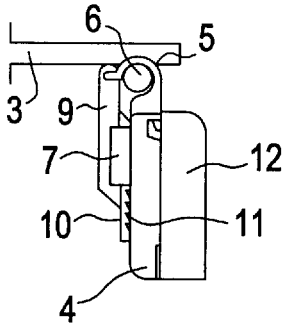
FIGS. 8A–C illustrate a second application of a holder arrangement according to the invention.
Figure 8B:
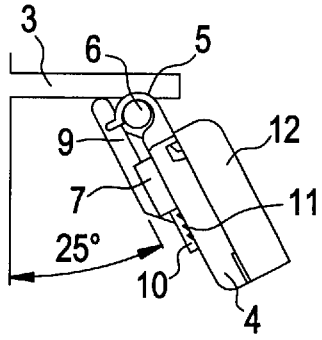
Figure 8C:
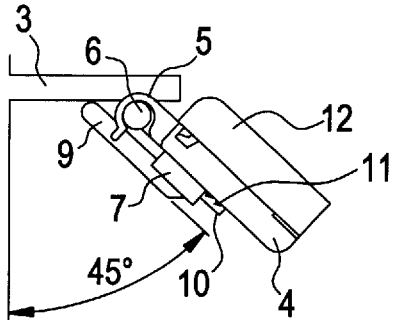

FIGS. 8A–C show how the holder can also be mounted on a transverse pin 6 arranged under the bar 3.

Figure 9A:
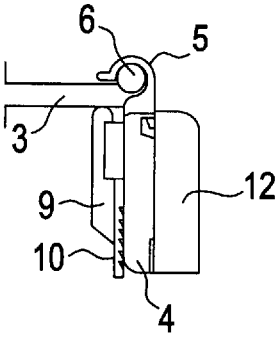
FIGS. 9A–B illustrate a third application of a holder arrangement according to the invention.
Figure 9B:
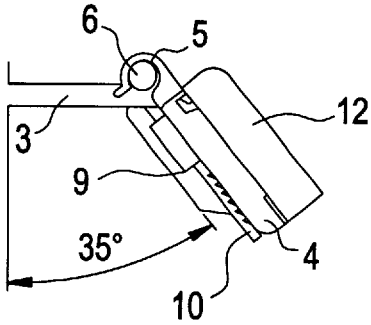

In a corresponding manner, in FIGS. 9A–B the holder is mounted on a transverse pin 6 arranged on the upper surface of the bar 3.

The holder described is simple to manufacture and mount as the mounting members 5 are made in one piece with the remainder of the holder.

In the embodiment shown, the holder comprises two hook-shaped members 5 which are simply snapped firmly on the transverse pin 6 on either side of the bar 3. The slide 9 will then enter into engagement with the bar 3 between the hook members 5, which produces a stable arrangement.

Figure 10:
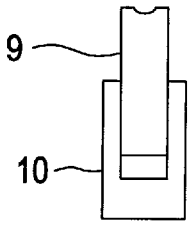
FIG. 10 illustrates an alternative embodiment of the adjustment slide having a concave end.

In the alternative embodiment shown in FIG. 10, the end surface of the slide 9 which interacts with the bar 3 is concave.

The invention has been described above in connection with the preferred embodiment shown in the drawing. However, this can be varied in a number of respects within the scope of the patent claims. Therefore, for example, the exact design of the slide 9 and its guidance on the holder 4 can be changed. The locking of the slide in different positions can be effected in an optional manner, and it is also possible to bring about continuous locking of the slide by using suitable friction material on the latter and/or on the associated guide.

What is claimed is:

1. A label holder intended to be mounted in a hanging manner on a pin (6) which is arranged transversely to a bar (3) projecting from a product display stand or equivalent, which holder (4) is provided with members (5) which make possible articulated mounting of the holder on the pin (6) and members (7–10) for adjusting the angle the holder forms with the bar, characterized by an adjustment member which is arranged on the rear side of the holder (4) and comprises a displaceable engagement element (9, 10) which is adapted so as to be capable of being displaced upward in the direction of the bar (3) so that it can enter into engagement with the bar when the holder (4) forms different angles with the latter and in this connection constitute a support for the holder which retains the latter in an angular position occupied relative to the bar (3), characterized in that the engagement element (9, 10) is linearly displaceable toward the bar.

2. A label holder intended to be mounted in a hanging manner on a pin (6) which is arranged transversely to a bar (3) projecting from a product display stand or equivalent, which holder (4) is provided with members (5) which make possible articulated mounting of the holder on the pin (6) and members (7–10) for adjusting the angle the holder forms with the bar, characterized by an adjustment member which is arranged on the rear side of the holder (4) and comprises a displaceable engagement element (9, 10) which is adapted so as to be capable of being displaced upward in the direction of the bar (3) so that it can enter into engagement with the bar when the holder (4) forms different angles with the latter and in this connection constitute a support for the holder which retains the latter in an angular position occupied relative to the bar (3), characterized in that the engagement element (9, 10) is in the form of a slide which runs in a guide (7) on the rear side of the holder (4), and in that the slide and the holder are provided with interacting members (8, 11) for locking the slide in the desired position relative to the holder.

3. The label holder as claimed in claim 2, characterized in that said interacting members comprise a series of engagement grooves (11) on one part and an engagement strip (8), intended for interaction with these, on the other part.

4. The label holder as claimed in claim 3, characterized in that the slide (9, 10) is made and arranged in such a manner that the interacting members (8, 11) are held in lockign engagement with one another in the rest position.

5. The label holder as claimed in claim 2, characterized in that the holder (4) is provided with two hook-shaped members (5) located at a distance from one another for snap-mounting the holder on the pin (6).

6. The label holder as claimed in claim 5, characterized in that the two hook-shaped members (5) are located on different sides of the projecting bar (3), and in that the displaceable slide (9, 10) projects up between these for engagement with the underside of the bar.

7. The label holder as claimed in claim 2, characterized in that the end surface of the slide (9, 10) which interacts with the bar is concave.

* * * * *